US005222727A

United States Patent [19]

Jacobsen

[11] Patent Number: 5,222,727

[45] Date of Patent: Jun. 29, 1993

[54] SIDE-GRIPPING CONVEYOR

[75] Inventor: Kennet Jacobsen, Eksjö , Sweden

[73] Assignee: IDAB-WAMAC AKTIEBOLAG, Eksjo, Sweden

[21] Appl. No.: 884,590

[22] Filed: May 18, 1992

[30] Foreign Application Priority Data

May 24, 1991 [SE] Sweden ..... 9101581

[51] Int. Cl.[5] ..... B65H 29/04

[52] U.S. Cl. ..... 271/205; 271/277

[58] Field of Search ..... 271/205, 206, 204, 277

[56] References Cited

U.S. PATENT DOCUMENTS 1,079,218 11/1913 Curtis ..... 271/204 X
4,577,855 3/1986 Reist ..... 271/204 X
4,779,717 10/1988 Eberle ..... 271/204 X
4,896,874 1/1990 Muller ..... 271/205 X

FOREIGN PATENT DOCUMENTS 0302534 2/1989 European Pat. Off. .
2519610 11/1976 Fed. Rep. of Germany .
3025697 1/1982 Fed. Rep. of Germany .
3716673 11/1987 Fed. Rep. of Germany .
3803549 8/1989 Fed. Rep. of Germany .

*Primary Examiner*—Richard A. Schacher
*Attorney, Agent, or Firm*—Keck, Mahin & Cate

[57] ABSTRACT

A side-gripping conveyor arrangement functions to transport a steam of mutually overlapping newspapers carried by a substantially horizontal conveyor belt with one edge margin of the newspaper stream extending freely over one side of the conveyor belt. The conveyor arrangement includes a conveyor chain (30) which is guided along the edge margin of the newspaper stream and which supports spring clips (20) having legs (22) which are biased towards one another. The legs carry mutually opposing gripping elements (23) which are guided between an open and a closed position by means of guide arms (24) attached to the legs (22) of the U-shaped clip. The legs are also provided with slide buttons (27) which run on cam paths (50) for effecting the opening and closing movement of the clips (20).

10 Claims, 2 Drawing Sheets 60
61
26
24
28
22
II
1
II
30
4
23
5
3
21
25
24
2
22
27
40
51
26
20
50

31
24
22
23
20
40

IV
20
60
60
5
5
40
40
IV 50
20
40
60

SIDE-GRIPPING CONVEYOR

The present invention to a conveyor arrangement of the kind which is intended to convey, for instance, a stream of mutually overlapping newspapers or like articles and which comprises a conveyor path on which the newspaper stream is transported with the newspapers in mutually overlapping relationship, an endless chain, a chain-guide profile which extends along a section of one edge of the conveyor path and functions to guide the chain, gripping devices which are mounted in spaced relationship on the chain and which function to grip a side-edge of the newspaper stream conveyed, and in which guide means are provided for closing and opening the gripping devices as said devices move towards and away from their gripping positions.

The inventive arrangement, however, is not restricted to use solely with a stream of overlapping newspapers or similar flat objects, but can also be used in conjunction with separate flat objects, such as printing plates or the like. The invention, however, will be described in the following with reference to the transportation of a stream of mutually overlapping newspapers.

Newspapers can be transported with the aid of a conveyor chain which is provided with one gripping device for each object, thereby enabling the objects to be maintained in a given orientation, position and spacing between the newspapers, which is advantageous or at times even necessary with regard to many operations to be carried out on the newspaper stream. The cost of such conveyors, however, is high because of the high cost of the individual gripping devices, among other things, and also because of the necessity of initially positioning the newspapers correctly in relation to the gripping devices.

It is known to use a so-called side-gripping conveyor arrangement of the kind described in the introduction in the case of certain, simpler conveyor operations. This conveyor is able to grip the edge margin of a newspaper stream and then replace said newspapers on a co-running conveyor path. Such conveyors, however, have certain limitations. For example, in order to swing or rotate the newspaper stream in the plane of the newspapers, it is necessary to first rotate the stream through 90° and then bend the stream to the extend desired, while maintaining rotational orientation of said stream, whereafter the stream is rotated back so that it again lies in its original rotation plane.

One advantage with side-gripping conveyors is that it is not necessary to provide one gripping device for each newspaper in order to maintain the mutual orientation and position of respective newspapers in the stream, and the number of gripping devices provided may be considerably fewer than the number of newspapers gripped by said devices. Another advantage is that such devices do not require the newspapers to have a specific spacing and position in the newspaper stream.

A practical side-gripping conveyor is, however, mechanically complex. For example, the conveyor will comprise pivoted levers which are biased against stop means with the aid of respective separate springs, wherein gripping elements mounted on the levers, or arms, grip between one another. Because of this, the known side-gripping conveyor has not been accepted as an alternative solution in practice.

The object of the present invention is to provide a side-gripping conveyor of relatively simple construction, thereby providing an operationally reliable and economically attractive alternative for certain transportation situations, for example when the newspaper stream shall be transported without requiring the newspapers to have or to be given well-defined positions in the stream, i.e. when the newspaper stream is to be moved between two points while maintaining the stream structure.

According to the embodiment, the clips include a spring element which biases the mutually opposing gripping elements into aligned contact with one another, and the clips are opened as a result of bringing the clips legs into contact with a camming path, either directly or through the intermediary of guide arms, at the location at which the clips are to be opened or closed along the conveying path. According to one embodiment, the clip itself may comprise a generally U-shaped spring-steel element whose legs are formed in a manner to maintain the gripping elements in spring bias towards one another. According to another embodiment, the U-shaped clip is formed by shaping two L-elements from formable sheet steel and then spring-hardening said elements and connecting said elements in an overlap joint so as to form a plane-symmetrical clip.

The guide arms may be connected to the legs of the U-shaped clip or formed integral therewith, and constructed for coaction with the cam paths in a manner to achieve the desired opening and closing of the gripping elements in a controlled fashion.

According to another embodiment of the invention, the clips may be formed from a piece of spring-steel strip which is essentially flat and straight when in its rest state and to the opposing ends thereof generally rigid and straight elements are connected to form the clip legs, these legs being arranged to cross one another, as seen from one side of the clip, so that the free ends of the legs will be biased towards one another by the spring action of the spring-steel strip. In this regard, the legs may be constructed so as to hold the gripping elements directed towards one another. Whereas the embodiment first described affords, in practice, a maximum gripping width of 25 mm, the embodiment last described, comprising mutually crossing legs, affords a gripping width of from 65 to 85 mm and also eliminates the need of forming L-elements separately, of separately hardening these elements and of mutually connecting said elements, by using a commercially available spring-steel strip which is flat and straight when in a state of rest.

In the embodiment comprising said mutually crossing legs, the spring-steel strip may extend around more than 180°, for instance around an angle of 200°–270°, so as to enable the guide cam paths to act directly on mutually opposing surfaces of the spring-steel part, for instance diametrically opposed parts thereof. It will be seen, however, that the cam paths may act directly against the outer surface of the clips, and also against the legs of said clips.

If a longer usable spring path is desired between the gripping elements, the spring may be given the form of a helical spring made of wire, rod or strip material and including a desired number of turns.

According to one embodiment in which the web and legs of the clip are formed essentially from one single strip of spring steel, one leg of the clip may be provided with an opening through which the other leg extends, so that the clip will be loaded symmetrically.

The invention will now be described in more detail with reference to exemplifying embodiments thereof and also with reference to the accompanying drawings, in which FIG. 1 is a schematic, sectional view of an inventive arrangement;

Figure 1:
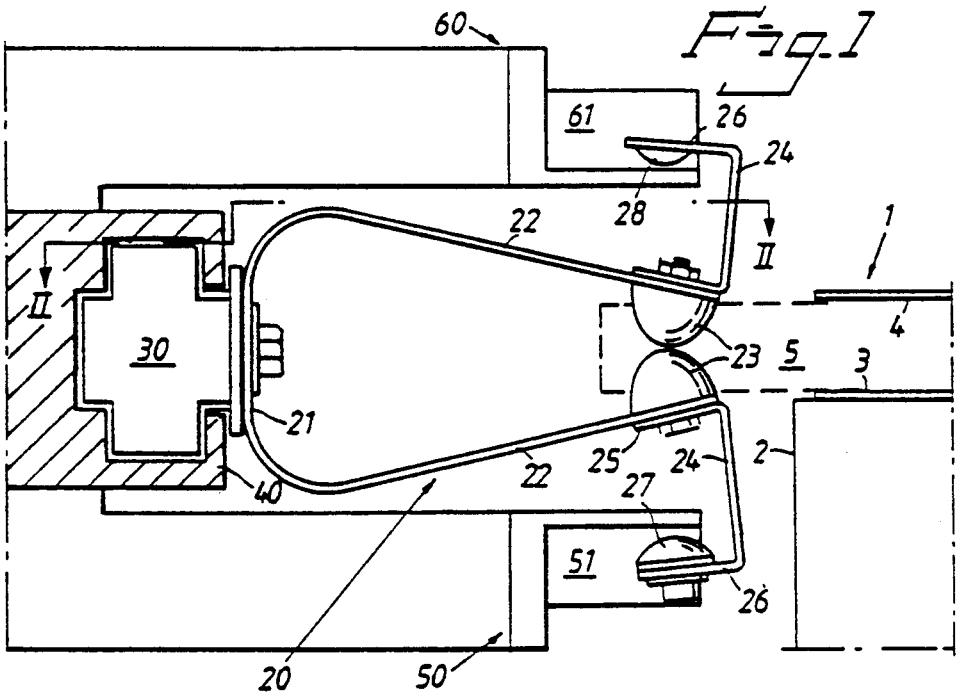

FIG. 1 illustrates a conveyor path 1 having a side surface 2 and a conveyor belt 3. As illustrated, the conveyor path may also include a top belt 4 which runs synchronously with the belt 3 so as to constantly maintain the distance and orientation of mutually overlapping newspapers in the newspaper stream 5 transported by the conveyor belt.

One edge margin of the newspaper stream extends out beyond the side surface 2 of the conveyor belt and can be gripped by a side-gripping clip 20 which is fixedly connected to a link 31 in a chain 30. The chain 30 is guided for movement in a circumferential path defined by a guide means 40, said chain being driven along the guide means by drive means not shown. The newspaper stream 5 can be laid-off onto a corresponding conveyor belt or path 1–4 (see FIG. 3).

Figure 2:
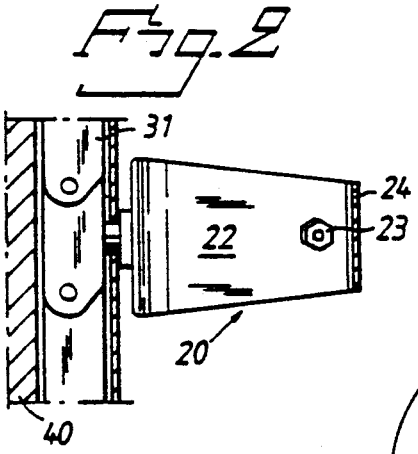
FIG. 2 is a view taken on the line II—II in FIG. 1.

The illustrated clip 20 has the form of a generally U-shaped element, or stirrup, whose web 21 is fixedly connected to a chain link 31 in said chain, wherein the legs 22 of the clip are provided on the inside of their respective free ends with mutually opposing gripping elements 23. The U-shaped gripper 20, or clip, is produced from spring steel having a thickness of about 1.5 mm and a width of about 80 mm and in other respects is configured in the manner shown in FIGS. 1 and 2, with the gripping elements spaced at a distance of about 100 mm from the web 21 and having a thickness of about 13 mm. The gripping force between the mutually abutting gripping elements 23 is about 30N, whereas the force exerted by the gripping elements 23 when spaced 30 mm apart is about 110N. This spring characteristic has been found suitable to afford correct gripping of newspaper streams of varying thicknesses, e.g. thicknesses which vary up to 25 mm.

The ends of the legs 22 are provided with outwardly angled operating arms 24 which, in accordance with one preferred embodiment illustrated at the bottom of FIG. 1, are fitted with a slide button 27, which in the illustrated case is comprised of a plastic material retailed under the trade name Robalon. The slide button coacts with a slide surface 51 on a cam path 50.

Shown at the top of FIG. 1 is a cam path 60 for coaction with the upper operating arm 24 of the U-shaped clip, said arm 24 having a pronouncedly convex part 28 as an alternative to the separate slide button 27, wherein the surfaces of the cam paths will preferably be made of low-friction material, such as Orlon (registered trademark).

The clip 20 is guided by the chain 30 whose rotational position is determined clearly by the guide bar or rail 40 which has a slot 41 via which the clip 20 is connected to the link 31.

Figure 3:
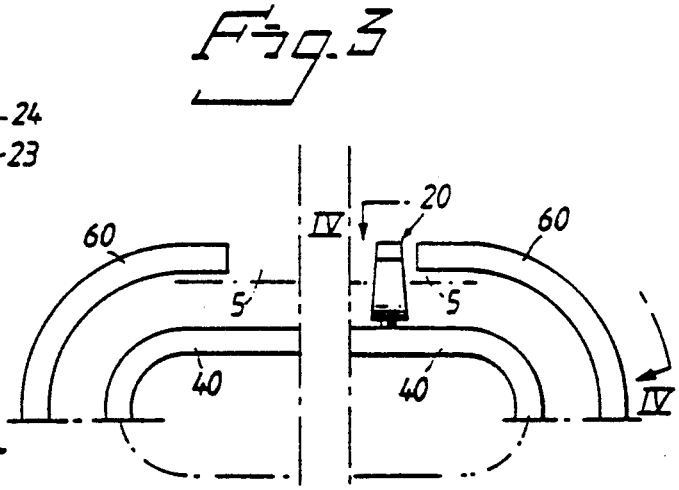
FIG. 3 is a schematic, horizontal view of the arrangement.
Figure 4:
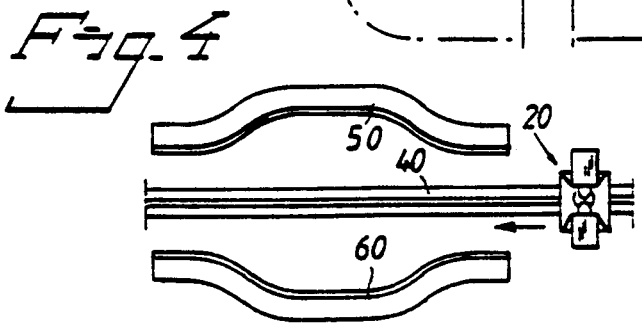
FIG. 4 is a schematic view taken on the line IV—IV in FIG. 3.
Figure 5:
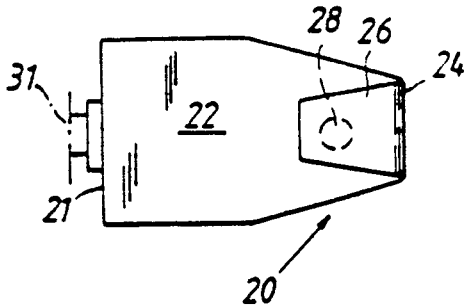
FIG. 5 is a top view of a clip-forming part of the arrangement illustrated in FIG. 1.

As will be seen from FIGS. 3 and 4, the cam path 60 has a section which extends in over the edge margin of the unsupported, straight section of the newspaper stream and then rises so that the upper leg of the clip will pass clear of the upper surface of the newspaper stream and then again drops so that the gripping element on the clip will engage the upper surface of the newspaper stream. In an analogous manner, the bottom guide cam 50 extends in a manner such that the clip 20 will open upon inward or outward passage of the clip over the edge margin of the newspaper stream. The clip 20 can be brought into correct engagement with the newspaper stream at different anticipated stream thicknesses, by guiding the two gripping elements 23 individually, through the intermediary of respective cam paths 50, 60. The clips may be spaced at a distance of 100 mm apart, for instance.

The clips 20 are preferably symmetrical around their centre planes, however, and the cam paths 50, 60 are arranged symmetrically in relation to the clips 20 and their guide means 30, 40.

FIG. 1 illustrates an exemplifying embodiment in which the operating arm 24 is attached to the ends of the legs 22 through the intermediary of a flange 25, by means of a screw joint which also supports the gripping elements 23. It will be understood, however, that the operating arm 24 may comprise an outwardly curved endpart of the clip leg 22 formed integrally therewith.

In the case of the FIG. 1 embodiment, each leg and a part of the clip web connected thereto forms a spring element. It will be understood, however, that the legs may be generally rigid and that the spring element of the clip may be formed by the clip web or parts thereof.

As described below, the resilient components of the clip may have the form of a spring which is firmly connected between the legs of said clip and which also forms the web of the clip. The spring may essentially have the shape of a U or may consist of a helical spring, a torsion spring or the like. The spring has a spring bias which urges the mutually directed gripping elements of the clip into central contact with one another. If the spring tensions the legs away from one another, the legs should thus cross one another and the gripping elements should face towards one another at their free ends. In those embodiments in which the spring biases the clip legs angularly away from one another and the legs thus cross one another, the cam devices may be caused to engage said legs immediately on the outer surface of the clip.

Alternatively, the spring may be constructed to bias the legs angularly towards one another, such as in the case of the FIG. 1 embodiment.

As shown in FIG. 3, the gripping devices, or clips, grip and release the newspaper stream in response to the curvature of the chain guide 40, for example at the turning ends of the conveyor chain, so that the newspaper stream can move straight forwards when the stream is gripped and released respectively. In the conveyor section between the gripping position and the release position, the chain guide 40 is normally rotated so that the newspapers will be transported in a hanging position, wherein guide rails (not shown) are arranged adjacent the chain guide 60 in those parts where the guide is rotated from its normal position, for instance such that the newspaper stream will lie horizontal and therewith can be curved in the vertical plane. The rails are thus intended to support the newspapers in a manner to enable the newspapers to spread in the symmetry plane of the clips.

Figure 6:
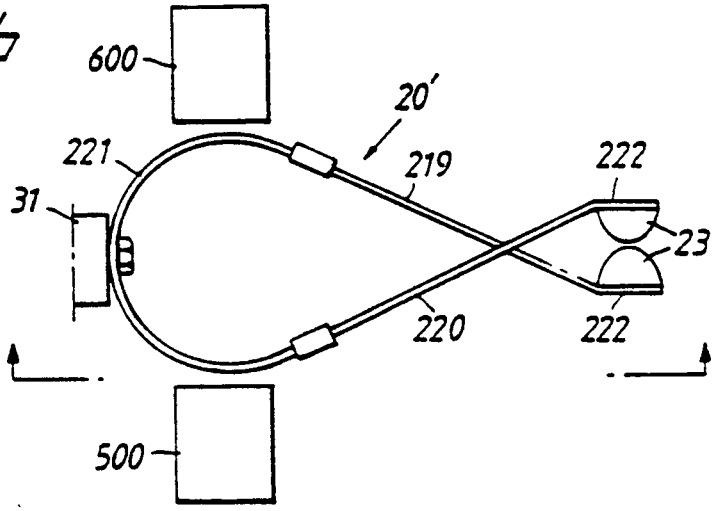
FIGS. 6 and 7 are respectively a side view and top view of another embodiment of a clip-forming part of said arrangement.
Figure 7:
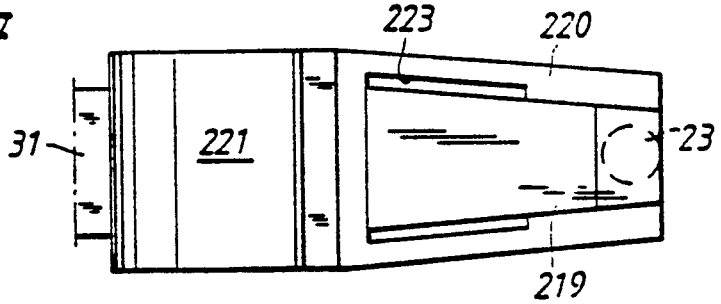

FIGS. 6 and 7 illustrate an alternative clip or gripper 20' which includes a pair of legs 219, 220 which cross one another and which are connected to oppositely located end-parts of a leaf-spring element 221 which is essentially flat in its state of rest and which can be bent elastically to resiliently urge the free ends 222 of the legs 219, 220 towards one another. The leaf-spring element preferably has a length such as to extend through a circular arc of slightly more than 180°, for example an arc of 200°-270°, thereby enabling the cam guide paths 500, 600 to act directly on diametrically opposed parts of the spring element 221.

The spring element 221 may be connected to a drive chain corresponding to the chain 30 in FIG. 1, i.e. in the symmetry plane of the gripper. The legs 219, 220 have provided on their respective free ends gripping elements which correspond to the gripping elements 23 of the embodiment illustrated in FIG. 1.

As illustrated in FIGS. 6 and 7, one leg 220 is preferably provided with an opening 223 through which the other leg 219 extends, said other leg 219 being narrower than the leg 220. This construction avoids tendencies of the legs to twist, although it will be understood that the legs may have the configuration illustrated in FIG. 8 so that they will lie adjacent to one another at their point of intersection and have laterally directed projections at their respective ends for supporting mutually opposed gripping elements.

Figure 8:
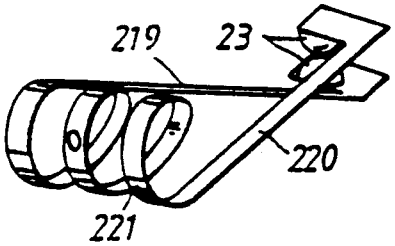
FIG. 8 illustrates another embodiment of a clip-forming part of the inventive arrangement.

In the alternative embodiment illustrated in FIG. 8, the spring element of the clip has the form of a helical spring which extends through a desired number of turns outside the smallest requisite angle, this angle being about 200°-270° when the legs are straight. This enables the clip to be given a desired spring constant appropriate for larger gripping widths of the clip, for example when a thicker newspaper stream is to be transported. Extension of the spring, for instance by using a helical spring, also reduces the risk of metal fatigue.

When the helical spring of the FIG. 8 embodiment is made of strip material, the spring can be fastened to a link in the chain 30 with the aid of a screw inserted through a screw hole provided preferably through one central spring turn, said helical spring preferably having an odd number of turns on the side thereof which faces the chain, so that the legs will spring symmetrically. However, non-symmetric attachment of the helical spring can be accepted and may even be advantageous in certain cases.

Alternatively, the spring can be attached to a chain link with a fitting which grips over or around part of the spring or the clip web.

I claim:

1. A side-gripping conveyor arrangement for conveying flat objects, selected from a stream of mutually overlapping articles and a stream of separate articles, comprising an endless chain (30), a chain guide profile (40) which functions to guide the chain (30), and gripping devices (20) which are mounted along the chain and function to grip a side margin of the articles conveyed, characterized in that the gripping devices include a plurality of separate spring clips (20), each comprising a pair of legs (22) which are connected to a clip web (21) and the free ends of which carry mutually opposing gripping elements (23) which are biased towards one another, a middle portion of each said web (21) being mounted on said chain (30); in that the separate clips have a symmetrical shape in the direction of their opening planes at right angles to the long direction of the chain (30) and are angularly oriented on the chain in a mutually similar fashion; and in that cam paths (50, 60) for controlled opening and closing of the clips respectively are arranged along the clip movement path in those regions where the clips are intended to grip and to release the articles conveyed; and in that the cam paths (50, 60) are arranged symmetrically in relation to said clips (20) and said chain guide profile (40) and are constructed to open the clips so as to enable said clips to pass freely over the edge part of the article movement path during movement towards and away from their respective gripping positions while guided by the chain profile (40).

2. A conveyor arrangement according to claim 1, characterized in that the clip (20) includes two legs (22; 219, 220) which are made of spring-steel strip and are connected to form an essentially plane-symmetrical U-shaped clip.

3. A conveyor arrangement according to claim 1, characterized in that each of the legs (22) of the clip (20) is provided with a guide means (24, 27, 28) in the form of an arm (24) which extends out from the leg and has an end-section (26) with a running means (27, 28), selected from a convex portion (28) and a slide button (27), for coaction with a respective cam path (50, 60).

4. A conveyor arrangement according to claim 3, characterized in that the running means (27, 28) run on running surfaces on the cam paths (50, 60) remote from the clip.

5. A conveyor arrangement according to claim 1, characterized in that the clip (20') includes a pair of legs (219, 220) which intersect one another in the opening plane of the clip and which are mutually connected by a spring element (221).

6. A conveyor arrangement according to claim 1, characterized in that the legs are mutually connected by a spring element in the form of a helical spring.

7. A conveyor arrangement according to claim 1, characterized in that the cam paths (50, 60) act directly on opposing, external parts of the clip.

8. A conveyor arrangement according to claim 5, characterized in that in the closed state of the clip the spring element (221) curves in an arcuate path greater than 180°; and in that the cam paths act directly on opposing convex parts of the leaf-spring element (221).

9. A conveyor arrangement according to claim 5, characterized in that one leg of the clip is provided with an opening and in that the other leg (220) of said clip extends through the opening in said one leg (219); and in that each leg has a generally symmetrical form in relation to a median plane extending parallel with the opening plane of the clip.

10. A conveyor arrangement according to claim 1, characterized in that the legs are essentially rigid and are connected to a spring element which forms the web of the generally U-shaped clip.

* * * * *